United States Patent [19]

Martelee

[11] 4,325,274

[45] Apr. 20, 1982

[54] HYDRAULIC FORCE PRODUCING DEVICE

[75] Inventor: Ghislain A. Martelee, Liege, Belgium

[73] Assignee: Cockerill, Seraing, Belgium

[21] Appl. No.: 158,442

[22] Filed: Jun. 11, 1980

[30] Foreign Application Priority Data

Jun. 22, 1979 [BE] Belgium ..... 0195900

[51] Int. Cl.[3] ..... B25B 17/00

[52] U.S. Cl. ..... 81/57.13; 81/57.29; 81/57.39; 81/58.1

[58] Field of Search ..... 81/57.29, 57.13, 57.39, 81/58.1

[56] References Cited

U.S. PATENT DOCUMENTS 1,698,618 1/1929 Bigelow ..... 81/57.29

2,952,176 9/1960 Mitchel ..... 81/58.1

4,141,262 2/1979 Smith ..... 81/57.39

FOREIGN PATENT DOCUMENTS 2256803 8/1975 France ..... 81/57.29

*Primary Examiner*—James L. Jones, Jr.

*Attorney, Agent, or Firm*—Stevens, Davis, Miller & Mosher

[57] ABSTRACT

A hydraulically operated device for applying a force to a component, for example to tighten a component such as a nut comprises a square peg to engage the nut, first hydraulic means in the form of a motor to rotate the square peg rapidly and second hydraulic means in the form of a piston and co-operating arm arrangement to rotate the pegs slowly with a substantial force.

9 Claims, 3 Drawing Figures

HYDRAULIC FORCE PRODUCING DEVICE

BACKGROUND OF THE INVENTION

The invention relates to a hydraulic device for producing a force to be applied to a component, either below or beyond the elastic limit of the material forming the component. A device of this kind can be used e.g. for tightening bolts and nuts at high torques.

In the manufacture of boiler components and mechanical appliances, it is conventional to tighten nuts and bolts mechanically at torques which may be in excess of 250 kg/meters. In order to reduce the labor of manual tightening, which requires considerable muscular effort, it has been proposed to provide a hydraulic tightening device which utilizes hydraulic energy to provide a tightening torque. This prior proposed device has a ratchet wheel driven by a pawl actuated by the piston of a hydraulic jack. A square peg secured to the ratchet wheel is connected to the bolt (or nut) to be tightened by means of a clamp or the like and the bolt is driven and thus tightened by a series of extension and retraction cycles of the jack piston. This prior proposed device has two main disadvantages. The first is that it takes a relatively long time for the initial tightening of the bolt since a number of extension and retraction cycles of the piston (normally a dozen) are required for each complete revolution of the nut or bolt. Consequently, a very large number of outward and return cycles of the jack piston are required before the device is retained in position by itself on the bolt (or nut) being tightened, by virtue of the torque applied to the bolt, and the resultant reaction force. During this initial phase, the workman has to hold the device in his hand until a reaction force is produced which holds the tool in position before final tightening. During each retraction stroke of the piston the reaction force falls to zero and the workman has to hold the device unless it stays in position through its own weight. A second disadvantage of the known device is that the ratchet wheel may not catch easily or operate reliably at the end of the stroke of the jack piston, when tightening is relatively complete. This is because the remaining piston stroke may then be insufficient for the pawl to move from one tooth to the next on the ratchet wheel and catch so that tightening can be completed. Experience has shown that, at this stage, the device often jams and cannot be released from the bolt. In addition, the prior device is inefficient during the initial tightening since it is adapted to withstand high pressures whereas, during the initial phase, it operates at low pressure and is therefore considerably over dimensioned.

OBJECT OF THE INVENTION

The object of the invention is to provide a device which substantially avoids the aforementioned awkward jamming.

Another object of the invention is to provide a device which automatically remains in position during use, and to speed up the initial tightening and, more particularly, to speed up the release of the device.

BRIEF SUMMARY OF THE INVENTION

According to this invention, there is provided a hydraulically operated device for applying a force to a component, said device comprising first engagement means adapted to abut a support surface, and second engagement means adapted to engage said component, and means for moving said second engagement means relative to said first engagement means, said moving means comprising a first hydraulically operated driving means mechanically coupled to the second engaging means and adapted to drive the second engaging means at a relatively high speed, and a second hydraulically operated driving means positioned to move the second engaging means at a relatively low speed but with a substantial force.

Preferably said first engagement means comprises a plate adapted to abut said support surface.

In a preferred embodiment said second engagement means comprises an externally toothed cylindrical rotatable member, the teeth of which are engaged by a worm gear, the worm gear being mounted on a shaft, the shaft being driven by a hydraulic motor comprising the first hydraulically operated driving means, and said externally toothed cylindrical member is provided with a square driving peg thereon, said square driving peg being adapted to be coupled to said component to apply a rotating force to said component.

Conveniently said externally toothed cylindrical member is rotatably mounted within an arm, said shaft and motor being mounted on said arm, said first engagement means being mounted on a second arm which is pivotally connected to the first arm, said second hydraulically operated driving means comprising a hydraulically operated piston mounted to move the arms pivotally apart, while the first driving means and associated gears retains said square peg fixed relative to the first arm, thus to impart a further rotational movement to said square driving peg relative to said first engagement means, and said arms are biassed towards one another by means of a spring.

In an alternative embodiment said rotatable cylindrical member is internally threaded and is engaged with an externally threaded shaft, so that on rotation of said cylindrical member said externally threaded shaft will move axially to apply said force to said component, and said second driving means comprise a piston and cylinder arranged between the end of the shaft and a part of the component to which said force is to be applied.

Preferably said cylindrical member is rotatably mounted within an arm, said shaft and motor being mounted on said arm, said first engagement means being connected to said arm.

A preferred embodiment of the invention comprises a device in which means which import a force are driven firstly by a first high-speed hydraulic driving means and then by a second low-speed hydraulic driving means to provide a force which increases to a predetermined value. In a most preferred embodiment, the high-speed driving means is a hydraulic motor and the low-speed driving means is a hydraulic jack. During the initial phase, the hydraulic motor is operated at an adjustable torque; as soon as a reaction occurs, the hydraulic motor stops and maintains a constant torque or force, whereas the hydraulic jack is actuated at the same time, so as to apply a force which increases to a predetermined value. As soon as the hydraulic jack is released, its return travel is automatically taken up by the rotation of the motor, so that the device is automatically held in position.

DETAILED DESCRIPTION OF THE ILLUSTRATED EMBODIMENT

Figure 1:
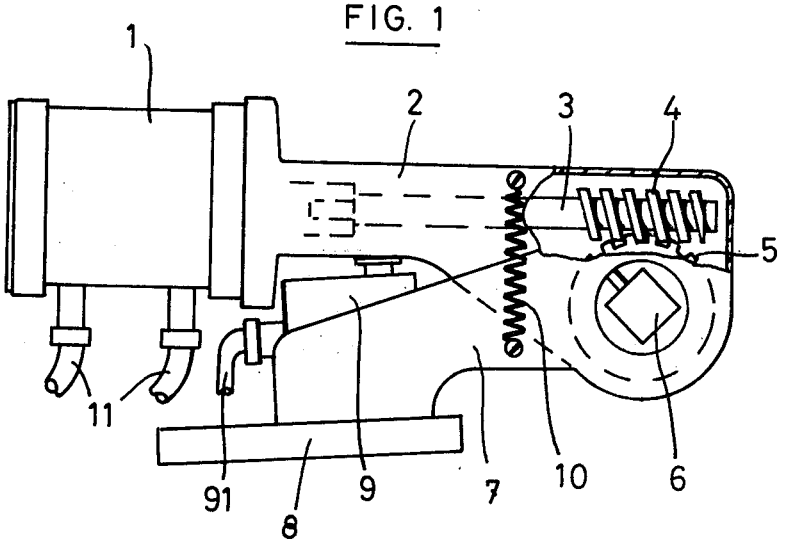
FIGS. 1 and 2 are a cut-away elevation and plan view respectively of an embodiment of the invention for tightening nuts and bolts, and FIG. 3 diagrammatically illustrates an embodiment for producing deformation.
Figure 2:
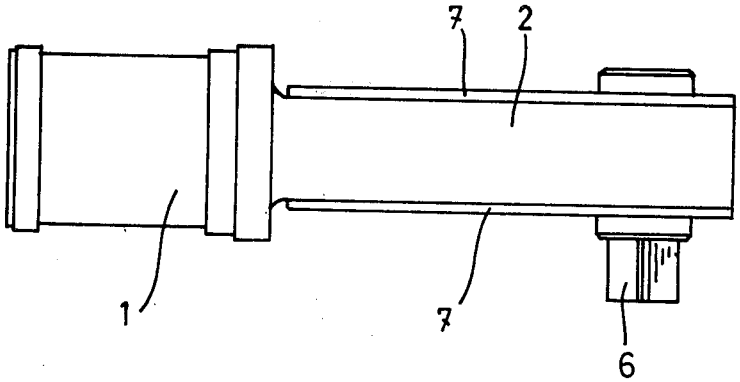

Referring now to the accompanying drawings, which illustrate the invention by way of example, in FIGS. 1 and 2, reference 1 denotes a hydraulic motor secured to one end of an action arm 2. The motor 1 is mechanically coupled to a shaft 3 to which a screw or worm gear 4 is keyed. The screw or worm gear 4 is engaged associated with a toothed sleeve 5 secured to a driving square peg 6. A clamp or the like (not shown) can be secured to the square peg 6 and fitted to the head of a nut or bolt which is to be tightened. At its free end, that is to say, the end remote from the motor 1 the action arm 2 is pivoted to a reaction arm 7 ending in a bearing plate 8. The arms 2 and 7 move pivotally about an axis which is coaligned with the axis of the square peg 6. A hydraulic jack or plunger 9 is disposed between arms 2 and 7 and held in position by a spring 10 which serves to bring the arms together. Motor 1 and jack 9 are connected to respective connections 11 and 91 to a hydraulic unit (not shown) actuated by the operator, using a remote-control device. The hydraulic motor 1 is for driving the high-speed action means constituted by the shaft 3, screw or worm gear 4, toothed sleeve 5 and square peg 6 at a relatively low torque and the hydraulic jack 9 is for driving the low-speed action means with a force which increases to a predetermined value, under the control of the operator.

The device is used as follows. The square peg 6 is connected to a bolt (for example) to be tightened. The plate 8 is kept in position, for example, by abutting it against a fixed object. Using a forward/stop/reverse switch on the remote-control device, the operator starts motor 1, which drives shaft 3 in rotation at high speed and consequently also drives square peg 6 via screw or worm gear 4 and the toothed sleeve 5. As a result, the initial tightening is done quickly, much more quickly than with the known device, and also continuously. As soon as a reaction occurs via the reaction arm 7, causing the arms 2 and 7 to pivot apart the motor 1 stops, maintaining a constant predetermined torque. The operator then actuates a push-button on the remote-control device in order to actuate jack 9. The jack piston then moves the arm 2 through an angle relative to arm 7, driving the square peg 6 and thus tightening the nut or bolt at low speed and at a force which increases to a preset measured maximum value. When the push-button is released, the jack piston returns and the arms 2 and 7 pivot towards each other under the bias of the spring 10. As the arms pivot towards each other the motor 1 automatically starts to rotate again, thus ensuring that a torque is applied to the bolt and automatically making up the return stroke of the jack. The device is thus automatically held in the operating position. The jack 9 may then be actuated again and the described cycle of operation repeated until the bolt is sufficiently tight. Tightening is thus done rapidly without any jamming.

In an advantageous embodiment, motor 1 and jack 9 may be releasably mounted on the respective arms of the tool, for example by means of respective ratchet and pawl mechanisms. In this manner, the tool proper can be carried about without being impeded by the hydraulic connections for the motor and piston, and the hydraulic connections can be placed at various positions, e.g. by securing motor 1 at a position selected from various positions angularly offset around its axis. There is thus no need for disconnect the hydraulic connections from the motor or piston and there is thus no risk of introducing dust into parts of the hydraulic circuit not protected by filters.

Figure 3:
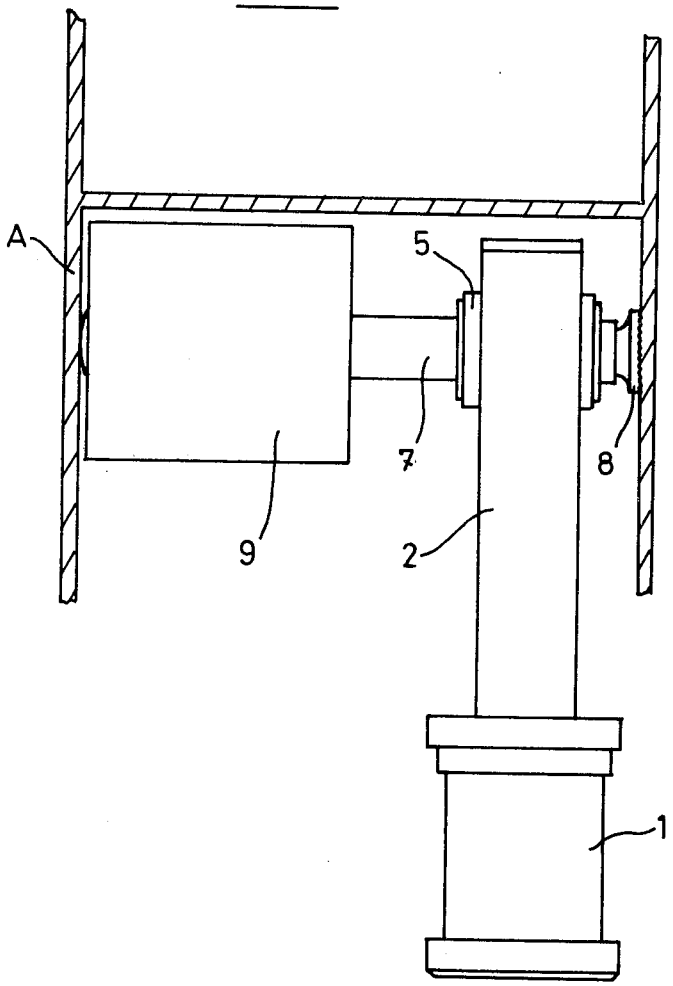

A device in accordance with the invention can also be adapted for other uses, for example in the deformation of components, e.g. for straightening deformed parts of an "I" sectioned beam, or the like. An embodiment intended for this purpose is illustrated, by way of example, in FIG. 3. References which are the same as in FIGS. 1 and 2 denote identical or equivalent components. As shown in FIG. 3, at the free end of an action arm 2, a shaft 7, which in this embodiment is externally threaded, extends perpendicularly to arm 2 and passes through a sleeve 5 which is internally threaded. The sleeve 5 is toothed, as in the embodiment of FIGS. 1 and 2, and is driven by a motor 1 via a screw or worm gear corresponding to the screw or worm gear 4 of FIGS. 1 and 2. As the sleeve 5 is rotated by the motor 1 the shaft 7 is driven longitudinally at high speed during the initial phase. The plate 8 is firmly mounted on arm 2, and abuts one flange of the "I" sectioned beam A. The hydraulic jack 9 is mounted at the end of shaft 7 and engages the other flange of the "I" beam. When the jack is actuated by the operator, it carries out the effective deformation work at low speed and with increasing force on the "I" beam A to be straightened.

In operation of the device the motor 1 is operated until the plate 8 and jack 9 are pressed against the flanges of the "I" beam A. Then the jack 9 is operated to straighten the beam. If the straightening requires more than one cycle of operation of the jack, as before, the return travel of the jack piston 9 is automatically compensated by the rotation of motor 1.

Of course, the embodiments described hereinbefore are only illustrative examples and can be varied by the one skilled in the art, within the spirit of the invention.

What is claimed is:

1. A hydraulically operated device for applying a force to a component, said device comprising:

first engagement means adapted to abut a support surface; and second continuous action engagement means mounted within a first arm to engage said component;

first hydraulically operated driving means mechanically coupled to the second engaging means and adapted to drive the second engaging means at a relatively high speed, said first driving means and associated gears retaining the second engagement means fixed relative to the first engagement means, and a second hydraulically operated driving means positioned to move the second engaging means with an increasing force at a relatively low speed but with a substantial force thus to impart a further movement to the second engagement means relative to the first engagement means.

2. A hydraulically operated device according to claim 1 wherein said first engagement means comprises a plate adapted to abut said support surface.

3. A hydraulically operated device according to claim 1 wherein said second engagement means comprises an externally toothed cylindrical rotatable member, the teeth of which are engaged by a worm gear, the worm gear being mounted on a shaft, the shaft being driven by a hydraulic motor comprising the first hydraulically operated driving means.

4. A hydraulically operated device according to claim 3 wherein said externally toothed cylindrical member is provided with a square driving peg thereon, said square driving peg being adapted to be coupled to said component to apply a rotating force to said component.

5. A hydraulically operated device according to claim 4 wherein said externally toothed cylindrical member is rotatably mounted within an arm, said shaft and motor being mounted on said arm, said first engagement means being mounted on a second arm which is pivotally connected to the first arm, said second hydraulically operated driving means comprising a hydraulically operated piston mounted to move the arms pivotally apart, while the first driving means and associated gears retains said square peg fixed relative to the first arm, thus to impart a further rotational movement to said square driving peg relative to said first engagement means.

6. A hydraulically operated device according to claim 5 wherein said arms are biassed towards one another by means of a spring.

7. A hydraulically operated device according to claim 3 wherein said rotatable cylindrical member is internally threaded and is engaged with an externally threaded shaft, so that on rotation of said cylindrical member said externally threaded shaft will move axially to apply said force to said component.

8. A hydraulically operated device according to claim 7 wherein said second driving means comprise a piston and cylinder arranged between the end of the shaft and a part of the component to which said force is to be applied.

9. A hydraulically operated device according to claim 8 wherein said cylindrical member is rotatably mounted within an arm, said shaft and motor being mounted on said arm, said first engagement means being connected to said arm.

* * * * *